US007150255B2

(12) United States Patent
Uruno et al.

(10) Patent No.: US 7,150,255 B2
(45) Date of Patent: Dec. 19, 2006

(54) ENGINE INCLUDING ELECTRICAL INTERFERENCE SHIELD

(75) Inventors: Hiroshi Uruno, Saitama (JP); Mamoru Mikame, Saitama (JP); Hirohisa Kitaura, Saitama (JP); Akira Hamauzu, Saitama (JP); Takashi Umemoto, Saitama (JP); Daisuke Hayashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 50 days.

(21) Appl. No.: 10/757,025

(22) Filed: Jan. 14, 2004

(65) Prior Publication Data

US 2004/0211382 A1 Oct. 28, 2004

(30) Foreign Application Priority Data

Jan. 28, 2003 (JP) ..... 2003-019334
Aug. 5, 2003 (JP) ..... 2003-286833

(51) Int. Cl.
*F02B 75/24* (2006.01)
*F02M 35/116* (2006.01)

(52) U.S. Cl. ..... 123/184.21; 123/198 E

(58) Field of Classification Search .....
123/184.21–184.61, 55.7, 198 E
See application file for complete search history.

(56) References Cited

U.S. PATENT DOCUMENTS 3,814,069 A * 6/1974 Croft et al. ..... 123/184.42
5,003,933 A 4/1991 Rush et al.
5,560,327 A * 10/1996 Brackett ..... 123/55.7
5,630,386 A * 5/1997 Uchida ..... 123/184.34
5,638,784 A * 6/1997 Ohsuga et al. ..... 123/184.34
6,053,148 A * 4/2000 Glovatsky et al. ..... 123/470
6,186,106 B1 * 2/2001 Glovatsky et al. ..... 123/143 C
6,296,536 B1 10/2001 Hitoshi et al.
6,325,053 B1 * 12/2001 Zappador et al. ..... 123/549
6,408,811 B1 * 6/2002 Glovatsky et al. ..... 123/184.61
2002/0179025 A1 12/2002 Glovatsky

FOREIGN PATENT DOCUMENTS

AT 315 008 B 5/1974

* cited by examiner

*Primary Examiner*—Marguerite McMahon
(74) *Attorney, Agent, or Firm*—Carrier, Blackman & Associates, P.C.; William D. Blackman; Joseph P. Carrier

(57) ABSTRACT

A shield cover for an engine is provided to shield electric parts, in an engine wherein an engine body includes a crankcase having a plurality of cylinder bores. An intake chamber common to all of the cylinder bores is spaced away from the crankcase. The shield cover is made in one piece, making it possible to reduce the number of parts and also of the cost, and to achieve a generally compact configuration of the engine. A plurality of electric parts 47L, 47R, 62L, 62R, 64 are disposed around an intake plenum 49, and the plural electric parts 47L, 47R, 62L, 62R, 64 are covered with a shield cover 67 attached to the engine body 12 in such a manner as to cover at least part of the intake plenum 49.

20 Claims, 9 Drawing Sheets

ENGINE INCLUDING ELECTRICAL INTERFERENCE SHIELD

CROSS-REFERENCE TO RELATED APPLICATIONS

The present application claims priority under 35 USC 119 based on Japanese parent application No. 2003-019334, filed 28 Jan. 2003 and No. 2003-286833, filed 05 Aug. 2003.

BACKGROUND OF THE INVENTION

1. Field of the Invention

The present invention relates to an internal combustion engine, including a crankcase having a plurality of cylinder bores. More particularly, the present invention relates to an engine with multiple horizontally-opposed cylinders, which is also provided with a shield to protect electrical parts of the engine against electromagnetic waves and high voltage.

2. Description of the Background Art

An engine having multiple horizontally-opposed cylinders already known, for example, in Japanese Laid-Open Patent No. 2002-213302.

If an engine such as that described in the above reference is incorporated, for example, in an airplane, then it is necessary to take countermeasures against electromagnetic waves and high voltage, for electric parts provided for the engine. In the conventional horizontally-opposed engine, it is necessary to individually shield the electric parts disposed discretely at different portions of the engine. Therefore, many high-cost parts must be used, and this gives rise to an increased number of parts required, and an increase in the cost of manufacture. As a result, the engine must be produced at a high volume in order to be profitable.

SUMMARY OF THE INVENTION

The present invention has been made in view of the situation described above, and it is an object of the present invention to provide a horizontally-opposed engine wherein electric parts are shielded from electromagnetic waves and high voltage, while making it possible to reduce of the number of parts and also of the cost of manufacture, and to achieve a generally compact configuration of the engine.

In order to attain the object described above, according to a first aspect of the invention, an engine has an engine body including a crankcase, and includes a plurality of cylinder bores.

The engine includes an intake plenum or intake manifold, having an intake chamber formed therein which is common to all of the cylinder bores, and the intake plenum or manifold is spaced away from the crankcase. A plurality of electric parts are disposed around the intake plenum or manifold, and the plurality of electric parts are covered with a single electromagnetic shield, attached to the engine body in such a manner as to cover at least part of the intake manifold.

According to an embodiment of the invention as set forth in a second aspect hereof, an engine is characterized, in addition to the configuration of the invention as set forth in the first aspect, in that the engine body includes the cylinder bores opposed to each other and sandwiching a crankshaft therebetween, which is rotatably supported in the crankcase, from the opposite sides thereof. In the second aspect, the intake plenum is disposed above the crankcase.

According to a third aspect of the described embodiment of the invention, an engine is characterized, in addition to the configuration of the invention as set forth the first aspect, in that an electronic control unit, which is one of the plurality of electric parts, is attached to an outer face of a side wall of the intake manifold, and a sensor for detecting a condition in the intake chamber extends from the electronic control unit through the side wall, and includes an end which is inserted in the intake chamber within the plenum or manifold.

Further, in order to attain the object described above, according to a fourth aspect of the described embodiment of the invention, the engine has an engine body including a crankcase with a plurality of cylinder bores, and an intake manifold having a plurality of intake pipes individually corresponding to the cylinder bores. The intake manifold is disposed on a side portion of the engine body, featuring a shield cover which interconnects the intake pipes, and covers a plurality of electric parts on the intake manifold.

According to an embodiment of the invention as set forth in the first aspect, the plurality of electric parts are covered with and shielded by the single shield cover. Consequently, the electric parts can be shielded while making it possible to reduce the number of engine parts, and also to reduce the cost and achieve a generally compact configuration of the engine.

According to an embodiment of the invention as set forth in the second aspect, in shielding a plurality of electric parts in a horizontally opposed engine with a single electronic shield cover, the number of parts can be reduced, the cost can be reduced, and a generally compact configuration of the horizontally opposed engine can be achieved.

According to an embodiment of the invention as set forth in the third aspect, the electronic control unit can be shielded, and the sensor for detecting a condition in the intake chamber, is connected directly to the electronic control unit. Consequently, the manual labor required to connect leads can be reduced or eliminated.

Further, according to an embodiment of the invention as set forth in the fourth aspect hereof, the plurality of electric parts are covered with and shielded by the shield cover provided on the intake manifold. Consequently, the electric parts can be effectively shielded while reducing the number of engine parts, and a generally compact configuration of the engine can be achieved.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

In the following description, selected illustrative embodiments of the present invention are described, in connection with working examples shown in the accompanying drawings. The selected embodiments and working examples are intended to illustrate, rather than to limit the invention.

Figure 1:
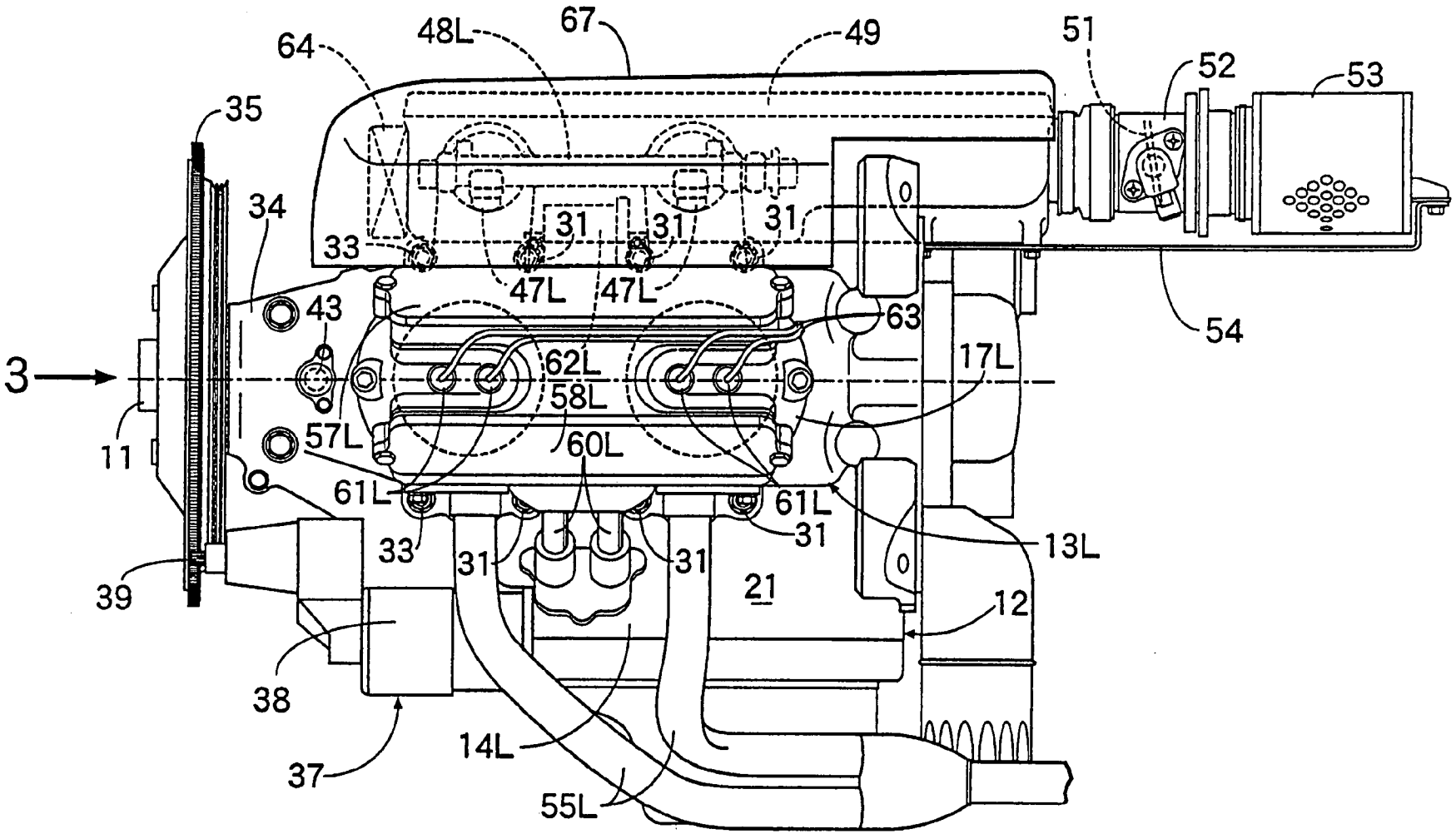
FIG. 1 is a side elevational view of an engine according to a first working example of a selected illustrative embodiment of the present invention.
Figure 2:
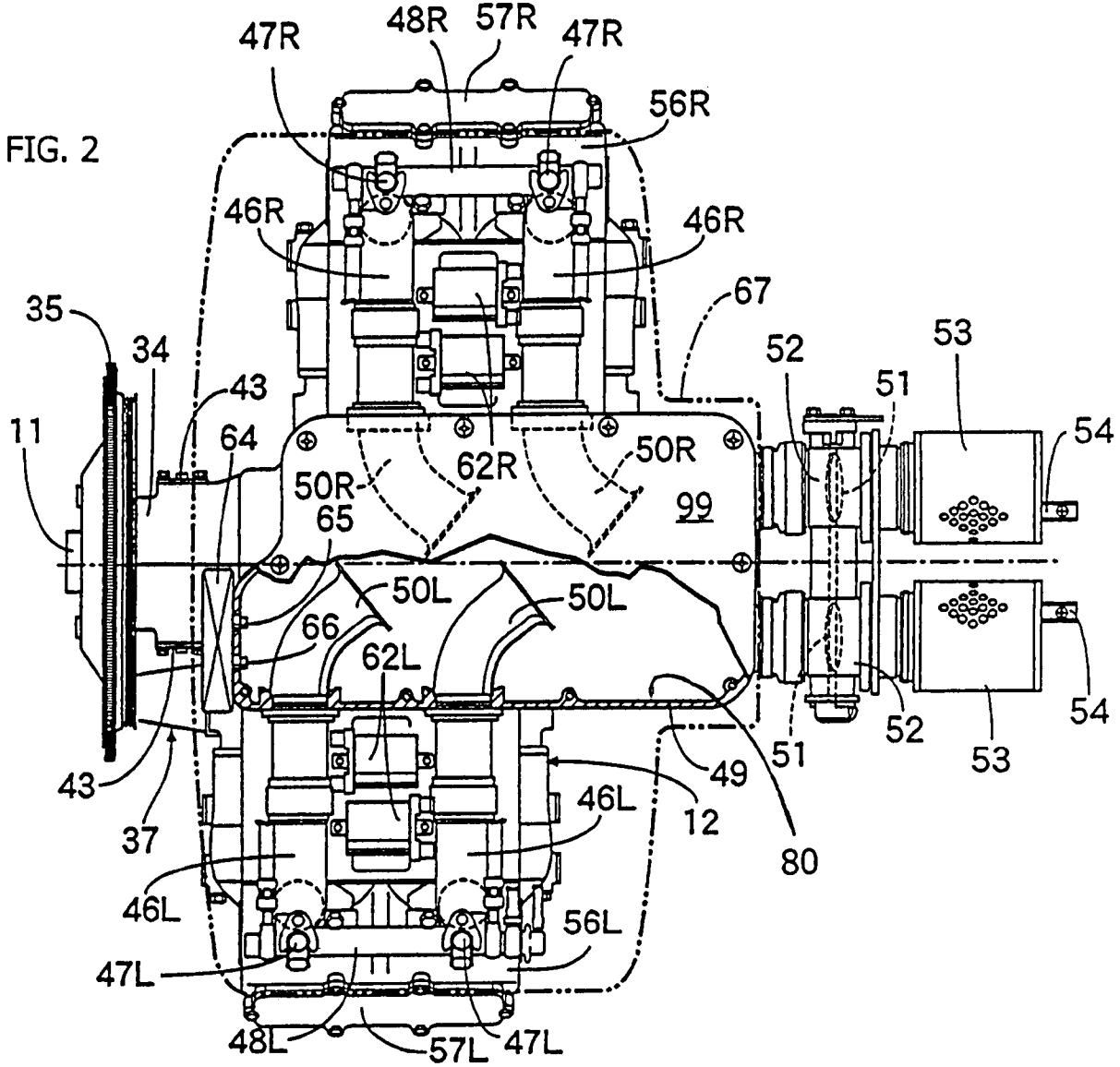
FIG. 2 is a top plan view, partly broken away, of the engine of FIG. 1.
Figure 3:
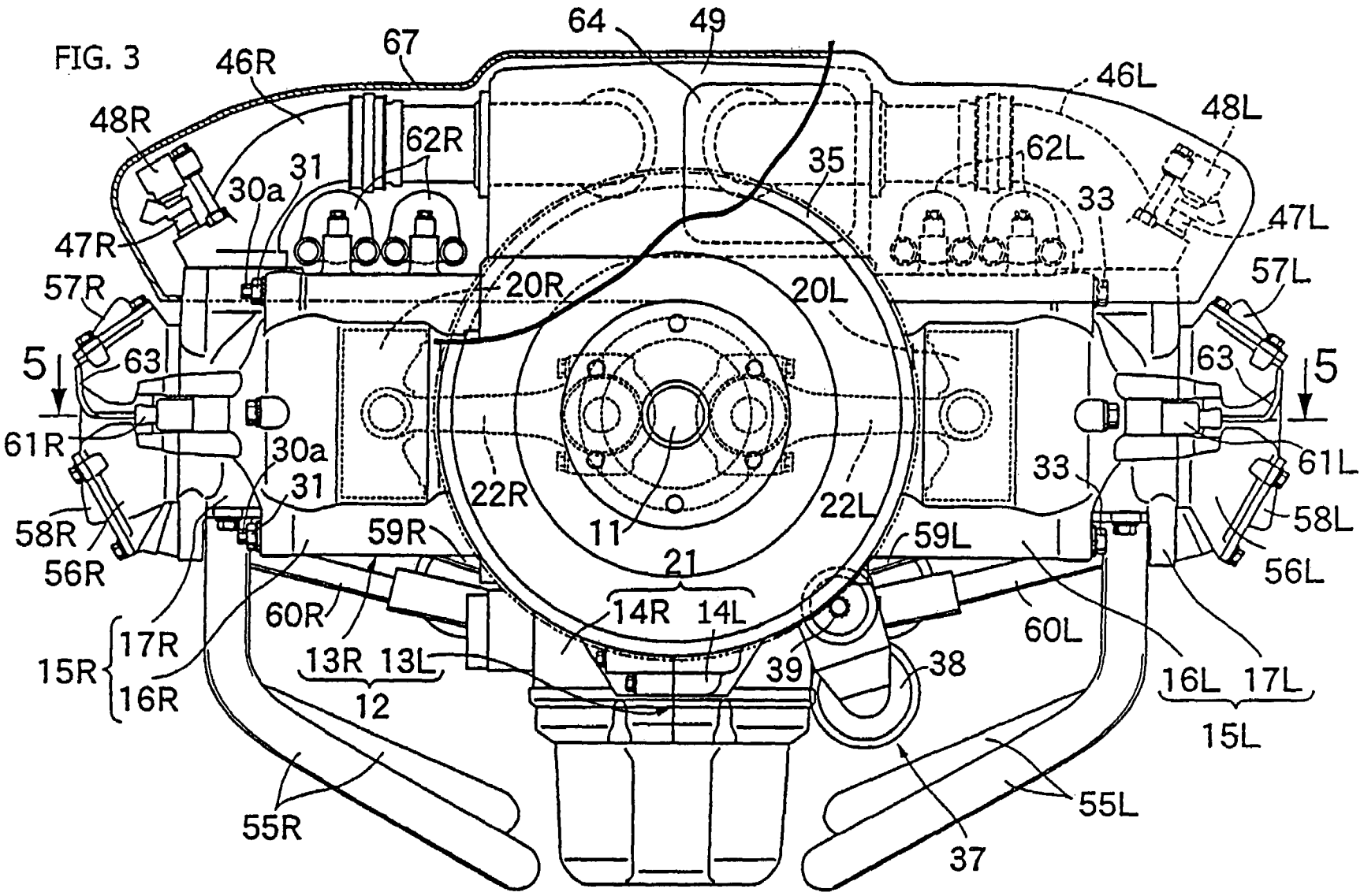
FIG. 3 is an enlarged front elevational view of the engine of FIGS. 1–2, as viewed in the direction indicated by an arrow mark 3 of FIG. 1.
Figure 4:
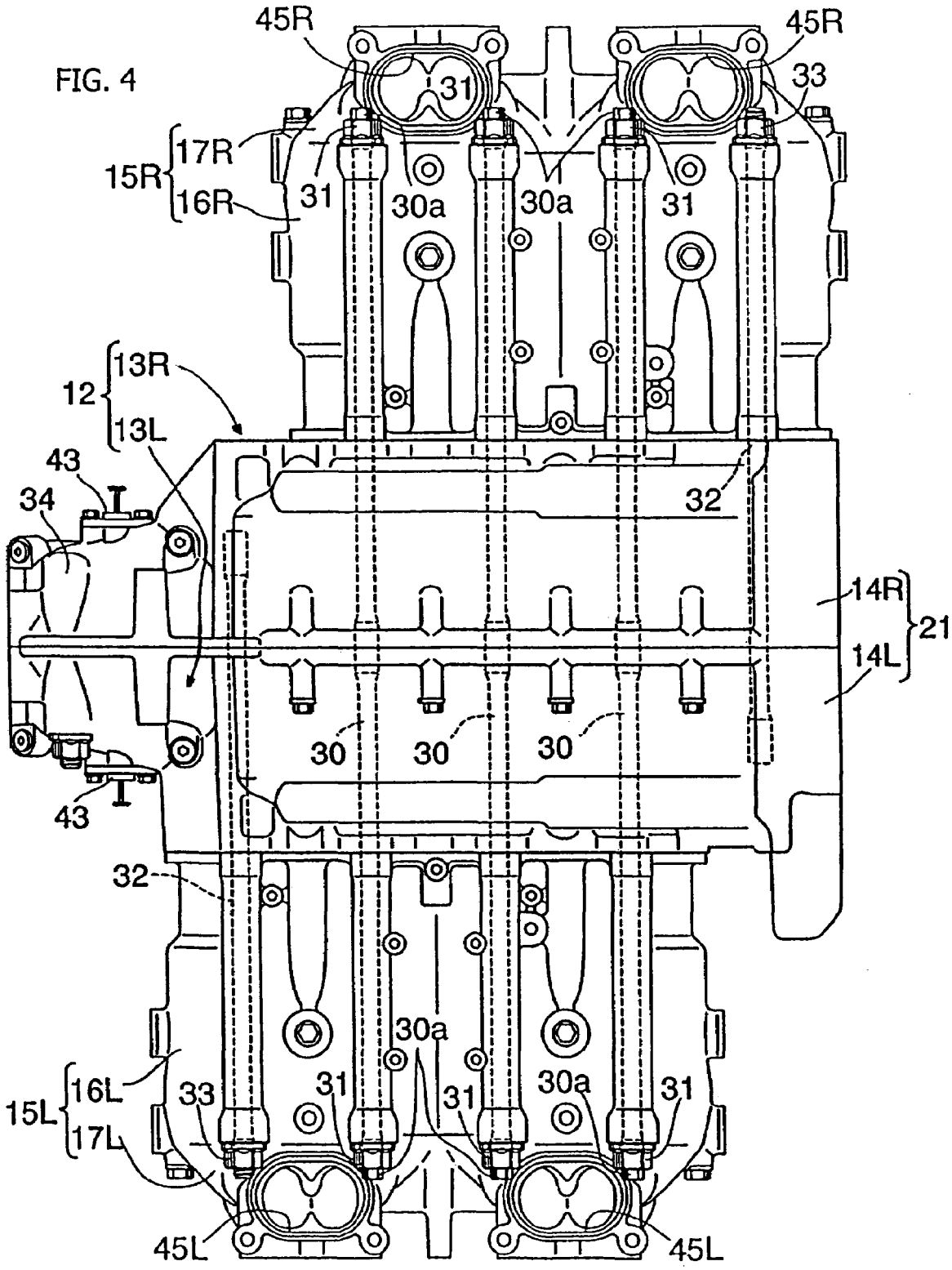
FIG. 4 is a top plan view of an engine body, which is part of the engine of FIGS. 1–3.
Figure 5:
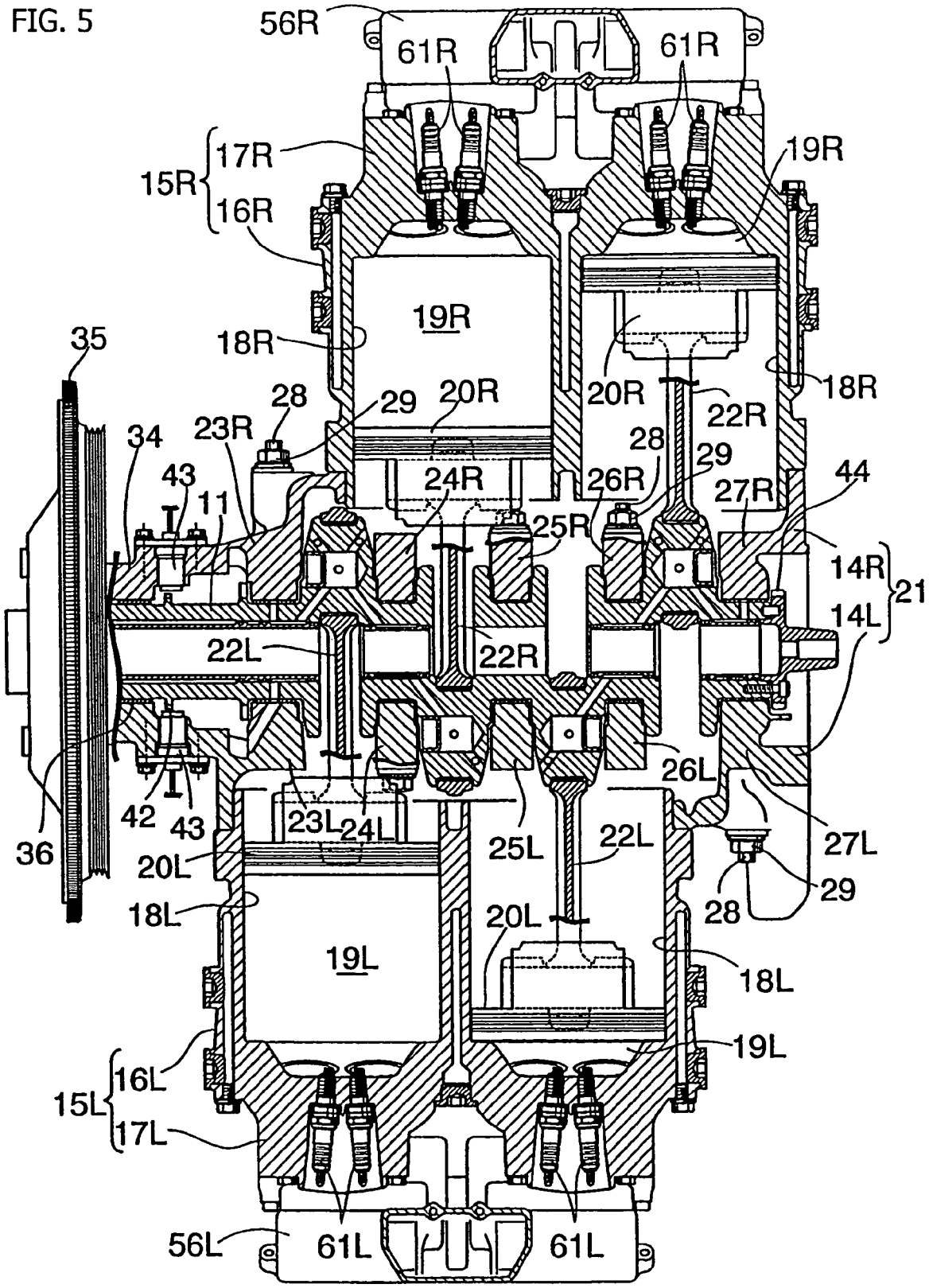
FIG. 5 is a sectional view of the engine of FIGS. 1–3, taken along line 5—5 of FIG. 3.
Figure 6:
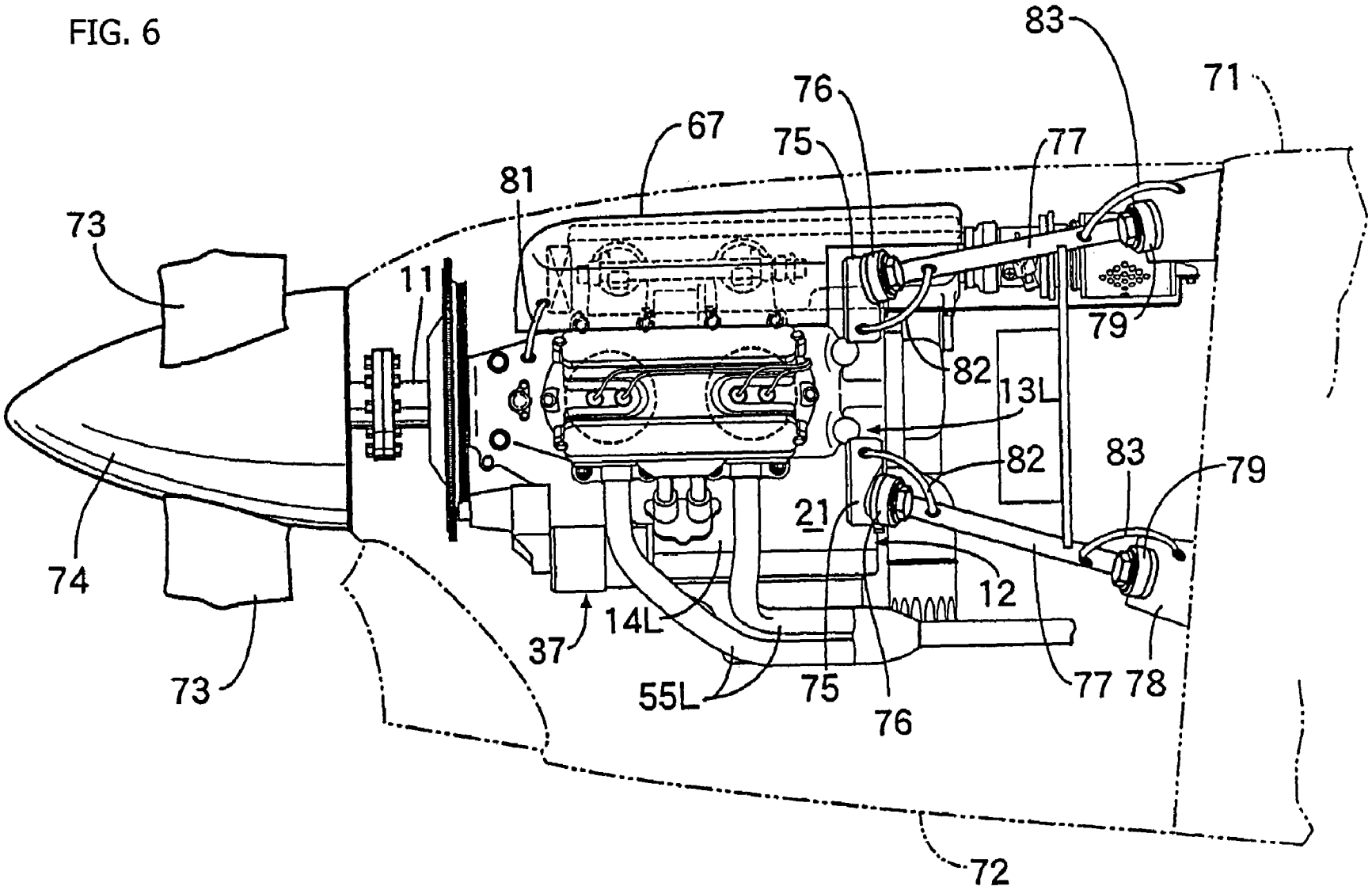
FIG. 6 is an environmental side plan view, partially broken away, of the engine of FIGS. 1–3 shown installed in the front end of an airplane.

FIGS. 1–6 show a first working example of the present invention, as applied to a horizontally opposed, four-cylinder, four-cycle engine. FIG. 1 is a side elevational view of the engine according to the first embodiment. FIG. 2 is a top plan view, partly cut away, of the engine. FIG. 3 is an enlarged front elevational view, as viewed in the direction indicated by an arrow mark 3 of FIG. 1. FIG. 4 is a plan view of the engine body, which is a part of the engine. FIG. 5 is a sectional view of the engine, taken along line 5—5 of FIG. 3. FIG. 6 is a side elevational view, partly cut away, of the engine shown incorporated in the front end of an airplane.

Referring first to FIGS. 1 to 3 and 6, the horizontally opposed, four-cylinder, four-cycle engine hereof is incorporated, for example, in an airplane, and is accommodated in a front cowl 72 of a body 71 of the airplane, and is situated such that an axial line of a crankshaft 11 extends forward and backward relative to a longitudinal axis of the airplane body. A propeller 74, having a plurality of propeller blades 73, is coaxially coupled to the front end of the crankshaft 11.

Referring also to FIG. 4, an engine body 12 of the engine includes a left engine block 13L, disposed on the left side when the engine is viewed from the rear, and a right engine block 13R, disposed on the right side when the engine is viewed from the rear (from the pilot's perspective).

The left engine block 13L includes a left crankcase 14L, and a left cylinder block 15L coupled to the left crankcase 14L. The right engine block 13R includes a right crankcase 14R coupled to the left crankcase 14L, and a right cylinder block 15R, coupled to the right crankcase 14R, on the side thereof opposite the left crankcase 14L.

The left cylinder block 15L includes a left cylinder barrel 16L coupled to the left crankcase 14L, and a left cylinder head 17L formed integrally with the left cylinder barrel 16L. The right cylinder block 15R includes a right cylinder barrel 16R coupled to the right crankcase 14R, and a right cylinder head 17R formed integrally with the right cylinder barrel 16R.

Referring further to FIG. 5, cylinder bores 18L, 18R are provided individually in the respective cylinder barrels 16L, 16R of the cylinder blocks 15L, 15R such that they substantially oppose each other, and sandwich the crankshaft 11 therebetween from the opposite sides, and such that they are offset from each other in a direction of the axial line of the crankshaft 11, as shown.

Pistons 20L, 20R are slidably fitted in the respective cylinder bores 18L, 18R, such that combustion chambers 19L, 19R are formed between the cylinder bores 18L, 18R and the cylinder heads 17L, 17R, respectively.

The engine block sections 13L, 13R are disposed in an opposing relationship to each other, such that the axial lines of the cylinder bores 18L, 18R thereof extend substantially horizontally. The left and right crankcase sections 14L, 14R are fastened to each other, such that they cooperate with each other to form the crankcase 21. The crankshaft 11 is connected to the pistons 20L, 20R through connecting rods 22L, 22R, and is rotatably supported between the left and right crankcase sections 14L, 14R.

A front journal support wall 23L, a first intermediate journal support wall 24L, a second intermediate journal support wall 25L, a third intermediate journal support wall 26L and a rear journal support wall 27L are provided in a spaced relationship from each other forward and backward on the opposite front and rear sides of the connecting rods 22L, and on the left crankcase 14L. The respective journal support walls 23L, 24L, 25L, 26L and 27L cooperate to support a left half portion of the crankshaft 11.

In similar fashion to that described above but on the opposite side, a front journal support wall 23R, a first intermediate journal support wall 24R, a second intermediate journal support wall 25R, a third intermediate journal support wall 26R and a rear journal support wall 27R are provided in a spaced relationship from each other forward and backward on the opposite front and rear sides of the connecting rods 22R, and on the right crankcase 14R. The respective journal support walls 23R, 24R, 25R, 26R and 27R cooperate to support a right half portion of the crankshaft 11.

It will therefore be understood that the crankshaft 11 is rotatably supported by the journal support walls 23L through 27L of the left crankcase 14L, and the journal support walls 23R through 27R of the right crankcase 14R.

The journal support walls 23L through 27L of the left and right crankcases 14L, 14R are fastened together by a pair of stud bolts 28 and a pair of nuts 29, which sandwich the crankshaft 11 therebetween from above and below. The stud bolts 28 are not all the same lenth, but rather, are sized and configured to fit their respective applications.

The stud bolts 28 for fastening the front journal support walls 23L, 23R and the rear journal support walls 27L, 27R are formed longer than the stud bolts 28 for fastening the first, second and third intermediate journal support walls 24L to 26L; 24R to 26R.

The nuts 29 are installed on the stud bolts 28, implanted on the front journal support wall 23L of the left crankcase 14L and extending through the front journal support wall 23R of the right crankcase 14R. The nuts 29 engage with an outer face of the right crankcase 14R. Further, the nuts 29 are installed on the stud bolts 28 implanted on the rear journal support wall 27R of the right crankcase 14R and extending through the rear journal support wall 27R of the left crankcase 14L. The nuts 29 also engage with an outer face of the left crankcase 14L.

Further, the nuts 29 are installed on the stud bolts 28 implanted on the second and third intermediate journal support walls 25L, 26L of the left crankcase 14L and extending through the second and third intermediate journal support walls 25R, 26R of the right crankcase 14R. The nuts 29 engage with the second and third intermediate journal support walls 25R, 26R. Furthermore, the nuts 29 are installed on the stud bolts 28 implanted on the first intermediate journal support wall 24R of the right crankcase 14R and extending through the first intermediate journal support wall 24L of the left crankcase 14L. The nuts 29 engage with the first intermediate journal support wall 24L.

The left, right engine blocks 13L, 13R are coupled to each other by pairs of through bolts 30 and two sets of pairs of stud bolts 32 individually disposed at portions of the left and right crankcases 14L, 14R which correspond to the first, second and third intermediate journal support walls 24L to 26L; 24R to 26R.

The through bolts 30 extend through the engine blocks 13L, 13R in such a manner as to cooperate with the crankshaft 11 to sandwich therebetween the stud bolts 28 individually disposed in pairs in the first to third intermediate journal support walls 24L to 26L; 24R to 26R in order to fasten the first, second and third intermediate journal support walls 24L to 26R; 24R to 24R to each other. Nuts 31 are individually installed at the opposite end portions of the through bolts 30 which project from the cylinder heads 17L, 17R of the left, right engine blocks 13L, 13R.

In order to prevent the through bolts 30 from being turned upon tightening of the nuts 31, tool engaging portions 30*a*, for example, of a hexagonal shape for engaging with a tool (not shown) are provided coaxially at the opposite ends of the through bolts 30 such that they individually project from the nuts 31.

The stud bolts 32 of one of the two sets of stud bolts 32 that are implanted on the front journal support wall 23R of the crankcase 14R and extend through the left engine block 13L, and nuts 33 are installed on the portions of the stud bolts 32 which project from the left cylinder head 17L of the left engine block 13L. Further, the other set of stud bolts 32 are implanted on the rear journal support wall 27L of the left crankcase 14L and extend through the right engine block 13R, and nuts 33 are installed on the portions of the stud bolts 32 which project from the cylinder head 17R of the right engine block 13R.

The stud bolts 32 are disposed at a position where they cooperate with the crankshaft 11 to sandwich therebetween a pair of stud bolts 28 for fastening the front journal support walls 23L, 23R of the left, right engine blocks 13L, 13R and another pair of stud bolts 28 for fastening the rear journal support walls 27L, 27R of the left, right engine blocks 13L, 13R.

A support cylinder 34 is formed cooperatively by the left and right crankcases 14L, 14R at a front portion of the crankcase 21, such that it projects forward. A front portion of the crankshaft 11 extends coaxially through the support cylinder 34, and projects from the front end of the support cylinder 34. A ring gear 35 is operatively secured to the portion of the crankshaft 11 which projects from the front end of the support cylinder 34, and a spinner (not shown) is coaxially attached to the ring gear 35. A slide bearing 36 is interposed between the front portion of the support cylinder 34 and the crankshaft 11, and an annular seal member (not shown) is interposed between the support cylinder 34 and the crankshaft 11, forwardly of the slide bearing 36.

Upon starting of the engine, rotational driving force is applied from a starting system 37 to the crankshaft 11. The starting system 37 is of a conventionally known type, which includes a starter motor 38 and a pinion 39. The starter motor 38 is supported at a lower portion of the left crankcase 14L of the crankcase 21. The pinion 39 projects so as to mesh with the ring gear 35, when the speed of rotation of the starter motor 38 increases higher than a predetermined value. After the engine is started, the pinion 39 is released from the ring gear 35, and returns to its original position.

A plurality of projections 42 are provided on a front portion of the crankshaft 11, in an equally spaced relationship from each other in a circumferential direction inside the support cylinder 34. A pair of crank angle sensors 43, 43 for cooperating with the projections 42 to detect the crank angle are attached to the support cylinder 34 in a spaced relationship by a phase of 180 degrees from each other.

As shown in FIG. 5, a drive gear 44 is coaxially attached to a rear end portion of the portion of the crankshaft 11 which projects from the rear journal support walls 27L, 27R. A rotor (not shown) of a generator, attached to a rear portion of the crankcase 21, is connected coaxially against relative rotation to the drive gear 44.

In addition, intake ports 45L, 45R are provided individually corresponding to the combustion chambers 19L, 19R at upper portions of the left, right cylinder heads 17L, 17R. The intake ports 45L, 45R are formed such that they are bifurcated and connected to the combustion chambers 19L, 19R, respectively.

As shown in FIGS. 2 and 3, arcuately curved intake pipes 46L, 46R are connected to the intake ports 45L, 45R and electromagnetic fuel injectors 47L, 47R are attached to intermediate portions of the intake pipes 46L, 46R, respectively. The electromagnetic fuel injectors 47L on the left engine block 13L side are connected to a common fuel rail 48L on the left hand side, while the electromagnetic fuel injectors 47R on the right engine block 13R side are connected to another common fuel rail 48R on the right.

An intake plenum 49 is spaced away from the crankcase 21 of the engine body 12, above the crankcase 21 in the horizontally opposed engine of the present working example, in such a manner that it is supported by the engine body 12. The intake plenum 49 includes a hollow housing 99 defining an intake chamber 80 therein (FIG. 2), and also includes a plurality of runners in fluid communication with the housing and extending therefrom to supply air to respective cylinders of the engine. Each of the runners includes a connecting pipe, and an arcuately curved intake pipe operatively attached to the connecting pipe, as will be further discussed herein. Further, upstream ends of the intake pipes 46L, 46R are connected to downstream ends of the connecting pipes 50L, 50R. Upstream end portions of the connecting pipes 50L, 50R project into the intake chamber 80 within the intake plenum 49 from the opposite sides thereof, and upstream end portions of the connecting pipes 50L, 50R are open rearwardly in an flared state, like a trumpet bell, in the intake chamber 80.

A pair of left and right throttle bodies 52, 52 each have a respective throttle valve 51 rotatably supported therein, and the throttle bodies 52 are connected at downstream ends thereof to a rear portion of the intake plenum 49. Air cleaners 53, 53 are connected to upstream ends of the throttle bodies 52, 52, and the air cleaners 53, 53 are supported by support stays 54, 54 which are attached to the intake plenum 49, and extend rearwardly therefrom.

Exhaust ports (not shown) are provided at lower portions of the left and right cylinder heads 17L, 17R and individually correspond to the combustion chambers 19L, 19R. Exhaust pipes 55L, 55R are connected to the exhaust ports, extend downwardly below and around the engine body 12, and further extend rearwardly from the engine, as shown by the left exhaust pipe 55L in FIG. 6.

Head covers 56L, 56R having a substantially H shape are coupled to the left and right cylinder heads 17L, 17R, respectively. Valve systems (not shown) for driving the intake valves and exhaust valves for controlling intake of air into the combustion chambers 19L, 19R and exhaust of air from the combustion chambers 19L, 19R are accommodated between the head covers 56L, 56R and the cylinder heads 17L, 17R. Upper cover plates 57L, 57R, for covering portions of the valve systems on the intake valve side, are fastened to upper portions of the head covers 56L, 56R. Meanwhile, lower cover plates 58L, 58R, for covering portions of the valve systems on the exhaust valve side, are fastened to lower portions of the head covers 56L, 56R.

The portions of the valve systems accommodated between the head covers 56L, 56R and the cylinder heads 17L, 17R on the intake valve side are given valve opening driving force by push rods which are pushed up at an intake stroke by power transmitted from the drive gear 44 of the crankshaft 11. The push rods of the individual combustion chambers 19L, 19R are movably inserted in axial directions in push rod guide pipes 59L, 59R. The push rod guide pipes 59L, 59R are disposed below the cylinder blocks 15L, 15R on the opposite left and right sides of the crankcase 21 and interconnect central portions forward and backward of lower portions of the left and right crankcases 14L, 14R and the head covers 56L, 56R.

The portions on the exhaust valve side of the valve systems accommodated between the head covers 56L, 56R and the cylinder heads 17L, 17R are given valve opening driving force by pull rods which are pulled down at an exhaust stroke by power transmitted from the drive gear 44 of the crankshaft 11. The pull rods of the combustion chambers 19L, 19R are inserted for movement in axial directions in pull rod guide pipes 60L, 60R. The pull rod guide pipes 60L, 60R are disposed below the push rod guide pipes 59L, 59R and interconnect central portions forward and backward of lower portions of the left and right crankcases 14L, 14R and the head covers 56L, 56R.

Pairs of ignition plugs 61L, 61R are attached individually for the combustion chambers 19L, 19R to the cylinder heads 17L, 17R, respectively. Ignition coils 62L, 62R, which are electric parts, are attached to side faces of upper portions of the cylinder heads 17L, 17R between the intake pipes 46L, 46R such that they are juxtaposed for each pair on the opposite sides of the intake plenum 49. Pairs of high-tension cables 63 are connected individually to the ignition coils 62L, 62R and connected to the ignition plugs 61L, 61R.

In order to make it certain that ignition occur in each of the combustion chambers 19L, 19R even if one of the ignition coils 62L, 62R in pair is disabled, the high tension cables 63, 63 connecting to the ignition coils 62L, 62R are connected to the ignition plugs 61L, 61R of the alternate combustion chambers 19L, 19R.

An electronic control unit 64, which is one of the plurality of electric parts, is attached to an outer face of a front side wall of the intake plenum 49 in order to control operation of the engine. An intake pressure sensor 65 and an intake air temperature sensor 66 for detecting the intake pressure and the intake air temperature, respectively, in the intake chamber 80, extend through the front sidewall of the intake plenum 49 into the intake chamber 80.

In addition, the electromagnetic fuel injectors 47L, 47R the ignition coils 62L, 62R and the electronic control unit 64, which are electric parts, are disposed around the intake plenum 49. In this instance, the electromagnetic fuel injectors 47L, 47R ignition coils 62L, 62R and electronic control unit 64 are covered with a shield cover 67 attached to the engine body 12 such that it covers at least part of the intake plenum 49.

The shield cover 67 is formed, for example, from a steel plate such that, in the present working example, it covers most part except a rear portion of the intake plenum 49 and an upper portion of the engine body 12. An opening edge of the shield cover 67 is formed such that it contacts the engine body 12. Also the high-tension cables 63 extending from the ignition coils 62L, 62R are partly covered with the shield cover 67.

Where such an engine as described above is incorporated in an airplane, as shown in FIG. 6, the engine body 12 is accommodated in a cowl 72, attached to a front portion of a machine body 71, such that the axial line of the crankshaft 11 thereof extends forward and backward, and is resiliently supported on the machine body 71. A propeller 74 having a plurality of blades 73 is disposed forwardly of the cowl 72, and the crankshaft 11 is coupled coaxially to the propeller 74.

Mounting members 75 are provided, for example, at four locations of a rear portion of the crankcase 21 of the engine body 12 such that they are positioned, for example, at the corners of a virtual right-angled quadrangle centered at the axial line of the crankshaft 11, within a plane perpendicular to the axial line of the crankshaft 11. The mounting members 75 are attached to front end portions of engine hangers 77 with resilient mounts 76 interposed therebetween. Rear end portions of the engine hangers 77 are attached to supporting members 78 provided at a front portion of the machine body 71 in corresponding relationship to the mounting members 75, with resilient mounts 79 interposed therebetween.

The shield cover 67 and the engine body 12 are electrically connected to each other at a plurality of locations, for example, at two locations, by bonding wires 81. The engine body 12 and the engine hangers 77 are electrically connected to each other individually by bonding wires 82 extending across the resilient mounts 76. The engine hangers 77 and the machine body 71 are electrically connected to each other individually by bonding wires 83 extending across the resilient mounts 79. The bonding wires 81, 82, 83 are each formed from a braided stainless metal wire.

Shield cover 67, engine body 12, engine hangers 77 and machine body 71 are electrically connected to each other by the bonding wires 81, 82, 83, by which the propeller blades 73, shield cover 67, and machine body 71 are placed in an electrically grounded state.

In one of the preferred embodiments, a plurality of electric parts, namely, the electromagnetic fuel injectors 47L, 47R, ignition coils 62L, 62R, and electronic control unit 64 are disposed around the intake plenum 49, located above the crankcase 21 of the engine body 12. The electromagnetic fuel injectors 47L, 47R, ignition coils 62L, 62R, and electronic control unit 64 around the intake plenum 49 are covered with the shield cover 67, attached to the engine body 12, such that it covers at least part of the intake plenum 49.

Accordingly, since the electromagnetic fuel injectors 47L, 47R, ignition coils 62L, 62R, and electronic control unit 64, which are a plurality of electric parts, are covered with and shielded by the single, unitary shield cover 67, the electric parts are shielded while the number of shielding parts are reduced, and a generally compact configuration of the engine is achieved, when compared with an alternative arrangement wherein the electric parts are individually shielded.

The high-tension cables 63 are partly covered with the shield cover 67, and at the portions covered with the shield cover 67, individual shields for the high-tension cables 63 can be removed. Therefore, a secondary voltage drop of the high-tension cables 63 can be improved by the removal of the individual shields.

Further, the electronic control unit 64 is attached to the outer face of the front side wall of the intake plenum 49, and the intake pressure sensor 65 and the intake air temperature sensor 66 for detecting the intake pressure and the intake air temperature in the intake chamber 80 extend from the electronic control unit 64 through the front side wall of the intake plenum 49, and into the intake chamber 80. Therefore, while shielding of the electronic control unit 64 is made possible, the intake pressure sensor 65 and the intake air temperature sensor 66 are connected directly to the electronic control unit 64, so that the labor for connection of leads can be reduced or eliminated.

Figure 7:
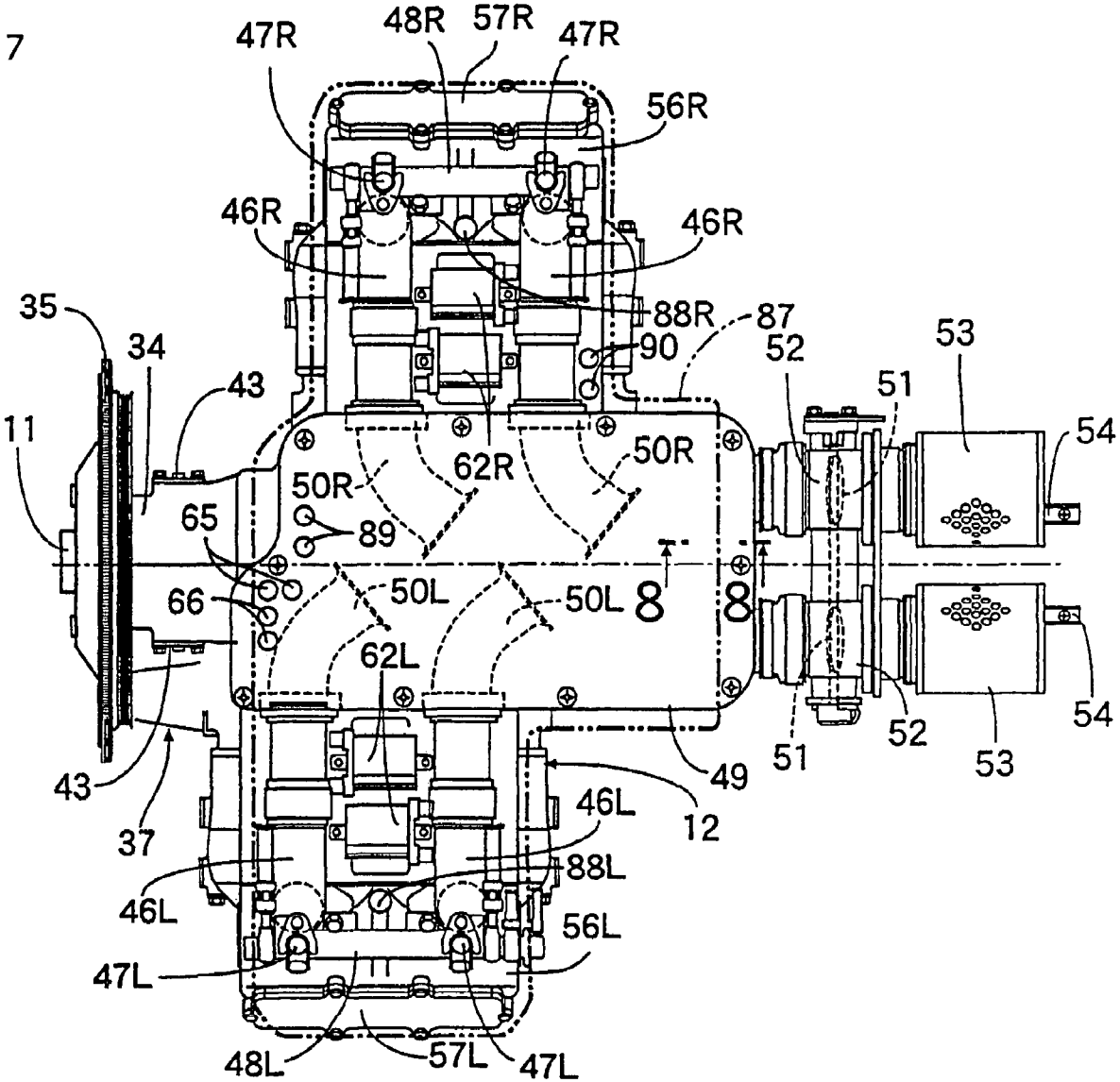
FIG. 7 is a top plan view, partly broken away, of an engine according to a second working example of the invention.
Figure 8:
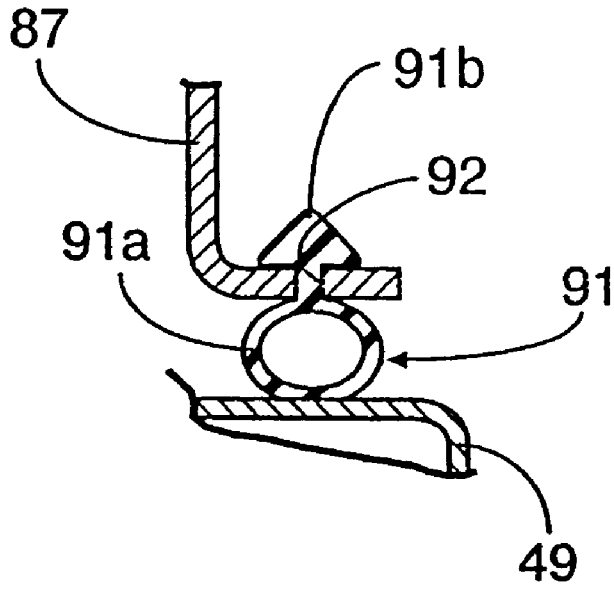
FIG. 8 is an enlarged sectional view of an intake manifold which is part of the engine of FIG. 7, taken along line 8—8 thereof.

FIGS. 7 and 8 show another preferred embodiment of the present invention; FIG. 7 is a top plan view, partly cutaway, of an engine, and FIG. 8 is an enlarged sectional view taken along line 8—8 of FIG. 7.

A shield cover 87 is attached to an engine body 12 such that it covers at least part of an intake plenum 49, and in the present preferred embodiment, the shield cover 87 covers most of the intake plenum 49. Electromagnetic fuel injectors 47L, 47R, ignition coils 62L, 62R, knock sensors 88L, 88R, and a pair of water temperature sensors 90, 90, that are electric parts, are disposed around the intake plenum 49 and are covered with the shield cover 87. Further, a pair of intake pressure sensors 65, 65, a pair of intake air temperature sensors 66, 66, and a pair of atmospheric pressure sensors 89, 89, which are electric parts, are disposed on the intake plenum 49 in such a manner as to be covered with the shield cover 87.

The maximum gap between the shield cover 87 and counterpart members to which the shield cover 87 is opposed, that is, the engine body 12 and the intake plenum 49, depends upon the shielding necessary for protection of an object from certain frequencies of electromagnetic waves. For example, the maximum gap where the electromagnetic wave of 100 MHz to 18 GHz is shielding an object is 4.17 mm. In order to prevent appearance of a gap greater than such a maximum gap just mentioned, such a gasket 91 as shown in FIG. 8 is interposed between the shield cover 87 and the intake plenum 49 and shield cover 87, which are counterpart members to which the shield cover 87 is opposed.

Gasket 91 is made of an electrically conductive, resilient material, and includes cylindrical portion 91*a* and engaging portions 91*b* formed integrally with cylindrical portion 91*a*. Cylindrical portion 91*a* is sandwiched between and yielded by the shield cover 87 and the intake plenum 49 or engine body 12. Engaging portions 91*b* are formed in an arrowhead shape, as shown, and are provided at a plurality of locations of an outer periphery of cylindrical portion 91*a*. Engaging portions 91*b* are situated and engaged with engaging holes 92 provided in the shield cover 87.

Also with the present second preferred embodiment, similar effects to those of the first embodiment described hereinabove can be achieved.

Figure 10:
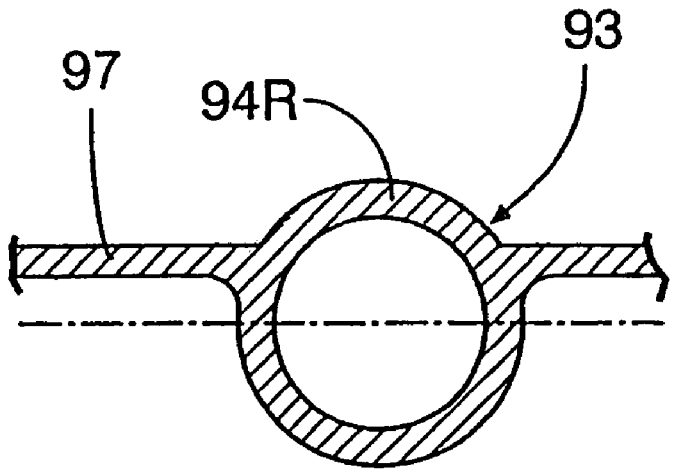
FIG. 10 is an enlarged sectional view of an intake manifold, taken along line 10—10 of FIG. 9.
Figure 9:
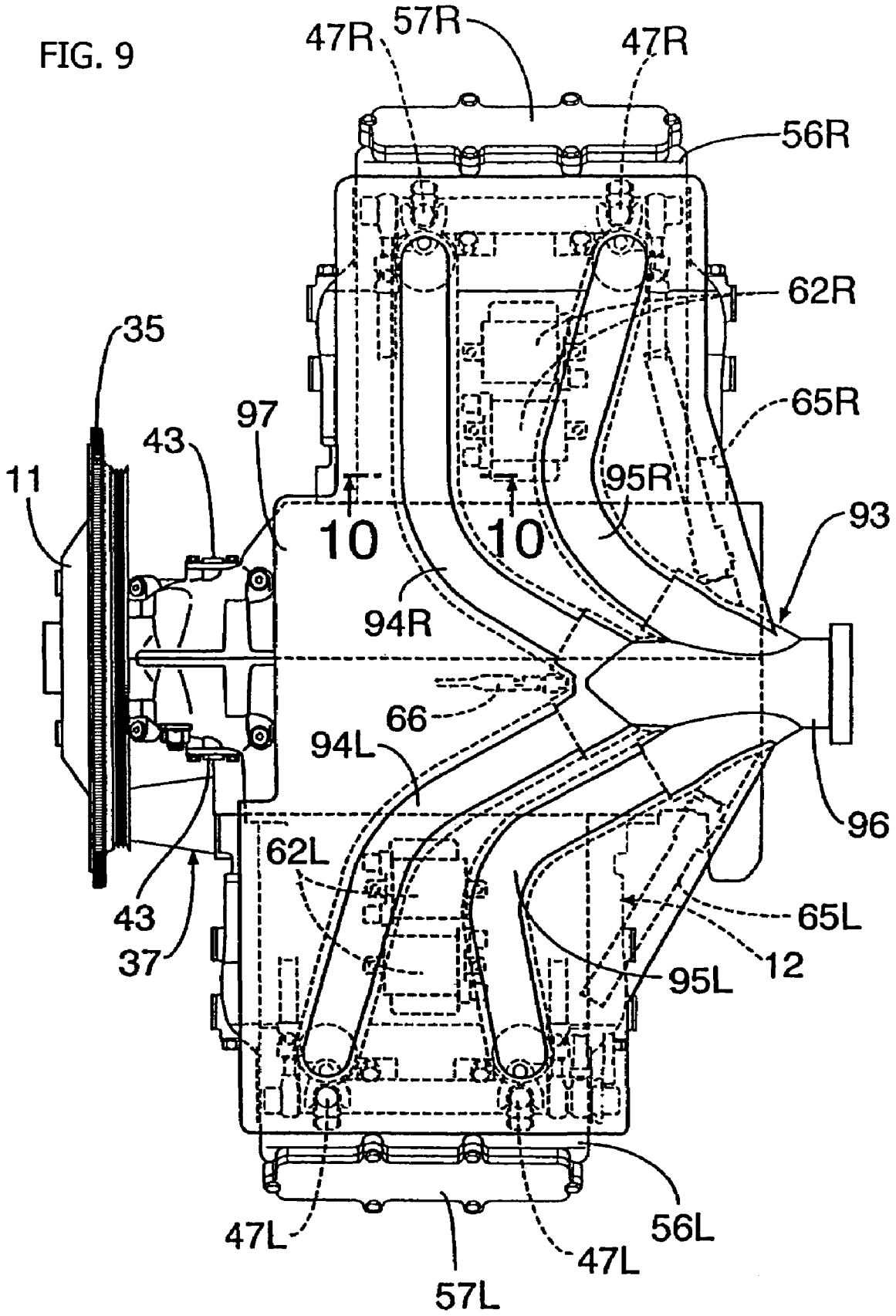
FIG. 9 is a top plan view of an engine according to a third working example of the invention.

FIGS. 9 and 10 show a third preferred embodiment of the present invention; FIG. 9 is a top plan view of an engine, and FIG. 10 is an enlarged sectional view taken along line 10—10 of FIG. 9.

An intake manifold 93 is disposed above an engine body 12. The intake manifold 93 includes intake pipes 94L, 95L, 94R, 95R individually corresponding to cylinder bores 18L, 18R provided in the engine body 12. The intake manifold 93 also includes a collecting intake pipe 96, to which upstream ends of the intake pipes 94L, 95L, 94R, 95R are commonly connected. The intake pipes 94L, 95L, 94R, 95R are formed such that they are curved to the rear side above the engine body 12. The collecting intake pipe 96 is disposed above a rear portion of the engine body 12 and connected to an intake chamber (not shown).

Shield cover 97 is provided on the intake manifold 93 in such a manner as to cover the engine body 12 from above and interconnects the intake pipes 94L, 95L, 94R, 95R. The shield cover 97 may be formed integrally with the intake pipes 94L, 95L, 94R, 95R as shown in FIG. 10, or may alternatively be welded to the intake pipes 94L, 95L, 94R, 95R.

The connection portions of the shield cover 97 to the intake pipes 94L, 95L, 94R, 95R are set to positions spaced from and opposite to the engine body 12 with respect to a plane which passes axial lines of the intake pipes 94L, 95L, 94R, 95R and is opposed to the engine body 12 in order to assure an accommodation space formed between the shield cover 97 and the engine body 12.

The electric parts such as the ignition coils 62L, 62R and the electromagnetic fuel injectors 47L, 47R disposed on the engine body 12, the intake pressure sensors 65L, 65R attached to the opposite sides of the collecting intake pipe 96 and the intake air temperature sensors 66, 66 in pair attached to the branching portions of the intake pipes 94L, 94R are covered with the shield cover 97.

According to the third embodiment of the present invention, a plurality of electric parts such as the ignition coils 62L, 62R, electromagnetic fuel injectors 47L, 47R, intake pressure sensors 65L, 65R, and intake air temperature sensors 66 are covered with and shielded by the shield cover 97 provided on the intake manifold 93. Consequently, the electric parts can be shielded, while reduction of the number of parts is achieved and a generally compact configuration of the engine is achieved.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having thus, described the invention, what is claimed is:

1. An engine, wherein an engine body including a crankcase includes a plurality of cylinder bores, and an intake plenum common to all of said cylinder bores is operatively attached to said engine body;

wherein a plurality of electric parts are disposed around said intake plenum, said plurality of electric parts comprising a plurality of electromagnetic fuel injectors and a plurality of ignition coils; and said plurality of electric parts are covered with a unitary shield cover attached to said engine body in such a manner as to cover at least part of said intake plenum and in such a manner that an electrically conductive gasket is provided between the shield cover and the engine body, the electrically conductive gasket providing a direct electrical connection between the shield cover and the engine body, wherein the shield cover is provided in a size and shape sufficient to protectively cover all of said fuel injectors and ignition coils.

2. The engine of claim 1, wherein said intake plenum comprises a hollow housing defining an intake chamber therein, and a plurality of runners in fluid communication with said housing and extending therefrom to supply air to respective cylinders of said engine.

3. The engine of claim 2, wherein each of said runners comprises a connecting pipe having an outwardly flared pickup end.

4. The engine of claim 2, wherein each of said runners further comprises an arcuately curved intake pipe operatively attached to said connecting pipe.

5. The engine of claim 2, wherein each of said connecting pipes curves rearwardly in said plenum.

6. An engine according to claim 1, characterized in that said engine body includes said cylinder bores opposed to each other and sandwiching a crankshaft, which is rotatably supported on said crankcase, from the opposite sides therebetween, wherein said intake plenum is disposed above said crankcase, and wherein said shield is configured to substantially cover said cylinder bores.

7. An engine according to claim 1, wherein said intake plenum comprises a hollow housing defining an intake chamber therein;

wherein an electronic control unit which is one of said electric parts is attached to an outer face of a side wall of said intake plenum; and wherein a sensor for detecting a condition in said intake chamber extends from said electronic control unit through said side wall and into said intake chamber.

8. The engine of claim 1, wherein said plurality of electrical parts includes at least two parts selected from the group consisting of coils, control modules, sensors, plug wires and injectors.

9. The engine of claim 1, further comprising at least one throttle body operatively connected to said intake plenum.

10. The engine of claim 9, further comprising an air cleaner housing operatively connected to said throttle body.

11. An engine, comprising:

an engine body including a crankcase having a plurality of cylinder bores formed therein, an intake plenum common to all of said cylinder bores, wherein said intake plenum is operatively attached to said engine body;

a shield cover operatively attached to said engine body and comprising a metal plate;

a ground connector electrically connecting said shield cover to said engine body, the ground connector comprising an electrically conductive gasket sandwiched between the shield cover and the engine body, the electrically conductive gasket providing a direct electrical connection between the shield cover and the engine body;

a plurality of electric parts disposed around said intake plenum, said plurality of electric parts comprising a plurality of electromagnetic fuel injectors and a plurality of ignition coils;

wherein said plurality of electric parts are covered with said shield cover attached to said engine body in such a manner as to entirely cover at least part of said intake plenum, wherein said cylinder bores are substantially opposed to each other and sandwiching a crankshaft, which is rotatably supported on said crankcase, from the opposite sides therebetween, wherein said intake plenum is disposed above said crankcase;

and wherein the shield cover is provided in a size and shape sufficient to protectively cover all of said fuel injectors and ignition coils.

12. An engine according to claim 11, wherein said intake plenum comprises a hollow housing defining an intake chamber therein characterized in that;

wherein an electronic control unit which is one of said electric parts is attached to an outer face of a side wall of said intake plenum; and wherein a sensor for detecting a condition in said intake chamber extends from said electronic control unit through said side wall and into said intake chamber.

13. The engine of claim 11, wherein said intake plenum comprises a hollow housing defining an intake chamber therein, and a plurality of runners in fluid communication with said housing and extending therefrom to supply air to respective cylinders of said engine.

14. The engine of claim 13, wherein each of said runners comprises a connecting pipe having an outwardly flared pickup end.

15. The engine of claim 13, wherein each of said runners farther comprises an arcuately curved intake pipe operatively attached to said connecting pipe.

16. The engine of claim 13, wherein each of said connecting pipes curves rearwardly in said plenum.

17. An engine according to claim 11, wherein said plurality of electrical parts includes at least two parts selected from the group consisting of coils, control modules, sensors, plug wires and injectors.

18. The engine of claim 11, further comprising at least one throttle body operatively connected to said intake plenum.

19. The engine of claim 11, further comprising an air cleaner housing operatively connected to said throttle body.

20. An engine, wherein an engine body including a crankcase includes a plurality of cylinder bores, and an intake plenum common to all of said cylinder bores is operatively attached to said engine body;

wherein a plurality of electric parts are disposed around said intake plenum, said plurality of electric parts comprising a plurality of electromagnetic fuel injectors and a plurality of ignition coils; and said plurality of electric parts are covered with a unitary electrical interference shield cover attached to said engine body through a gasket which provides a direct electrically conductive connection between the shield cover and the engine body, the shield cover configured to cover at least part of said intake plenum, wherein the shield cover is provided in a size and shape sufficient to protectively cover all of said fuel injectors and ignition coils, the shield cover providing a barrier which resists passage of external electromagnetic waves therethrough, in order to protect said plurality of electric parts.

* * * * *